US005329855A

United States Patent [19]

Szyndlar

[11] Patent Number: 5,329,855

[45] Date of Patent: Jul. 19, 1994

[54] CARTRIDGE FOR EXPLOSIVELY OPERATED INDUSTRIAL TOOLS

[75] Inventor: Janusz Szyndlar, Unionville, Canada

[73] Assignee: The Whitaker Corporation, Wilmington, Del.

[21] Appl. No.: 95,132

[22] Filed: Jul. 20, 1993

[51] Int. Cl.[5] ..... C06D 5/00

[52] U.S. Cl. ..... 102/530; 102/430; 102/470

[58] Field of Search ..... 102/204, 430, 464, 466, 102/467, 469, 470, 530, 531, 472; 227/9-11

[56] References Cited

U.S. PATENT DOCUMENTS

| | | | |
|---|---|---|---|
| 3,007,409 | 11/1961 | Broske . | |
| 3,026,803 | 3/1962 | Metzger | 102/466 |
| 3,155,039 | 11/1964 | Broske . | |
| 3,363,564 | 1/1968 | Gawlick et al. | 102/470 |
| 3,855,900 | 12/1974 | Barr et al. | 102/430 |
| 4,905,602 | 3/1990 | McBain | 102/530 |
| 4,913,055 | 4/1990 | Goto et al. | 102/470 |

FOREIGN PATENT DOCUMENTS

| | | | |
|---|---|---|---|
| 338397 | 10/1989 | European Pat. Off. | 102/204 |
| 81971 | 7/1895 | Fed. Rep. of Germany | 102/470 |
| 301423 | 4/1932 | Italy | 102/204 |
| 1169 | 6/1889 | Switzerland | 102/470 |
| 724 | of 1883 | United Kingdom | 102/470 |
| 1431 | of 1883 | United Kingdom | 102/470 |

OTHER PUBLICATIONS

AMP Troubleshooting Guide for AMPACT Taps and Application Tooling.

*Primary Examiner*—Harold J. Tudor

[57] ABSTRACT

An improved cartridge 24 is disclosed for use in an explosively operated industrial tool 10. The cartridge 24 includes a retaining plate 60 for assuring that, after firing the cartridge 24, the spent primer 32 cannot be inadvertently ejected into the interior of the tool 10, where it can subsequently adversely affect the performance of the tool 10. The retaining plate 60 is washer shaped having an upwardly turned beveled peripheral edge 64 that interferingly engages portions of a gas check member 36 that holds the primer 32. The retaining plate 60 has a hole 61 that allows access to the detonator cap 68 for firing yet will not permit passage therethrough of the detonator cap 68 itself.

8 Claims, 3 Drawing Sheets

CARTRIDGE FOR EXPLOSIVELY OPERATED INDUSTRIAL TOOLS

The present invention relates to cartridges for explosively operated industrial tools of the type having a gas check member that holds a two part primer.

BACKGROUND OF THE INVENTION

Explosively operated industrial tools utilizing cartridges having explosive powder and a primer for detonating the powder are disclosed in U.S. Pat. Nos. 3,007,409 and 3,155,039. Both of these patents disclose cartridges that include a gas check member that has one end adjacent the explosive powder and the other end facing outwardly with a detonator primer therein. An opening communicates between the primer and the explosive powder. A ram is arranged so that it can be made to slide into the open end of the cartridge, strike the primer, thereby igniting the explosive powder. Such tools, however, under certain conditions, allow the primer to be ejected from the cartridge into the interior of the tool after firing. In an attempt to solve this problem, a deforming gas check member was devised that would deform under the heat and forces generated during firing to retain the primer within the gas check member. Such a deforming gas check member is disclosed in U.S. Pat. No. 4,913,055, which teaches a two part plastic gas check member having a metal washer therebetween. During firing, a portion of the gas check member and the primer are temporarily caught between the ram and the washer and deformed so that the primer is retained within the gas check member. However, under certain circumstances this structure allows some of the expanding gases to penetrate the deforming plastic gas check member and pass completely through into the interior of the tool. These escaping gases will contaminate the tool and reduce the amount of force available at the end of the ram, sometimes to the point of compromising the performance of the tool. As the gas is expanding and pushing the gas check and the ram toward the work piece, the steel washer causes the primer to expand which in turn causes the gas check to expand. This occasionally causes the shell to expand outwardly a sufficient amount to wedge itself in the bore of the barrel, making it difficult to remove. Additionally, during assembly of this deforming gas check, a relatively high degree of dimensional accuracy must be maintained which tends to increase the cost of manufacture and results in a lower reliability of the cartridge.

What is needed is a structure that will positively retain both the primer and the detonator cap within the gas check member under these conditions without other adverse effects.

SUMMARY OF THE INVENTION

A cartridge is disclosed for use in an explosively operated industrial tool. The cartridge includes an elongated shell which is open at one end and closed at a base end. The shell has a chamber at the base end containing explosive powder. A gas check assembly is disposed within the shell adjacent the explosive powder and includes a gas check member having an outwardly facing first opening in a first end, the first opening extending through the member to a second end adjacent the explosive powder opposite the first end. A primer having a detonator cap is arranged within the first opening so that the detonator cap is facing outwardly. A retaining means is associated with the gas check member for retaining the primer within the first opening.

An embodiment of the present invention will now be described in detail with reference to the accompanying drawings.

DESCRIPTION OF THE PREFERRED EMBODIMENT

Figure 1:
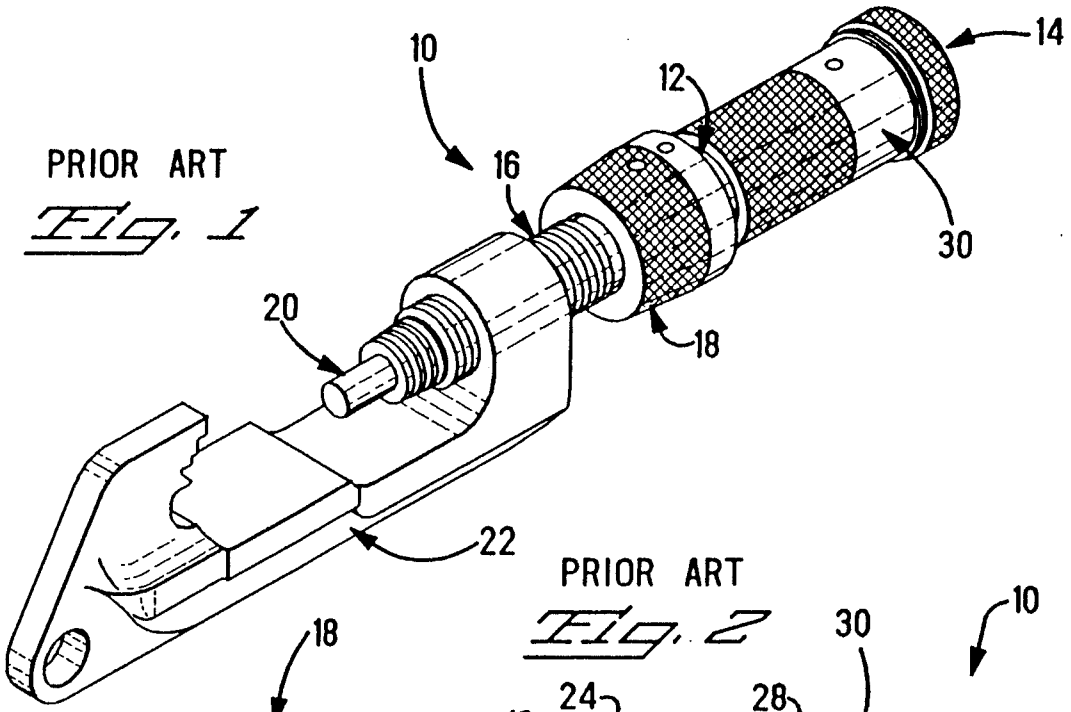
PRIOR ART FIG. 1
FIG. 1 is an isometric view of an industrial tool that utilizes an explosive cartridge incorporating the teachings of the present invention.
Figure 2:
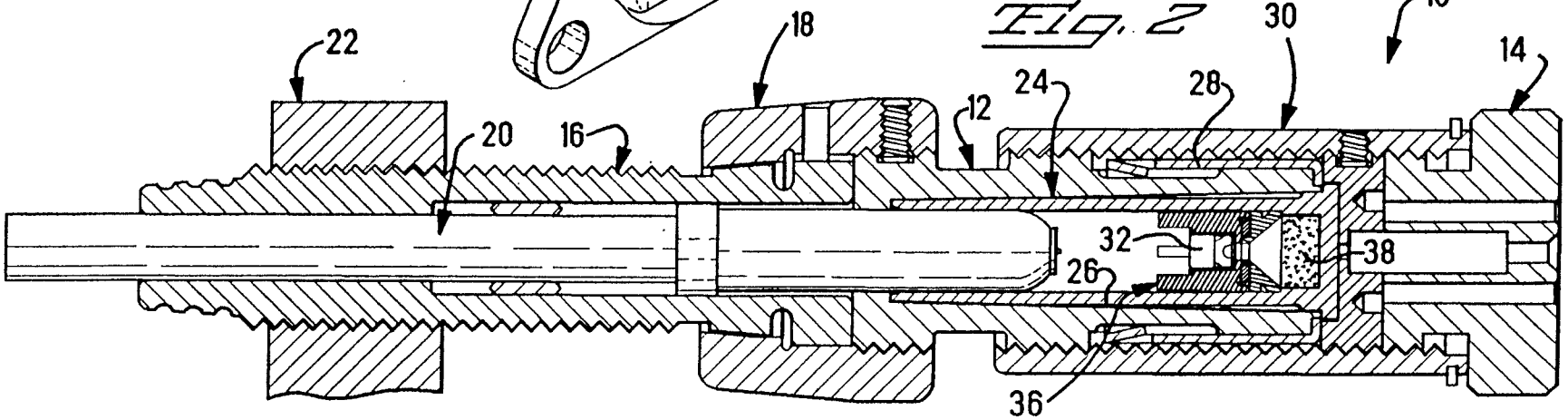
PRIOR ART FIG. 2
FIG. 2 is a partial cross-sectional view taken along the longitudinal axis of the tool shown in FIG. 1.
Figure 3:
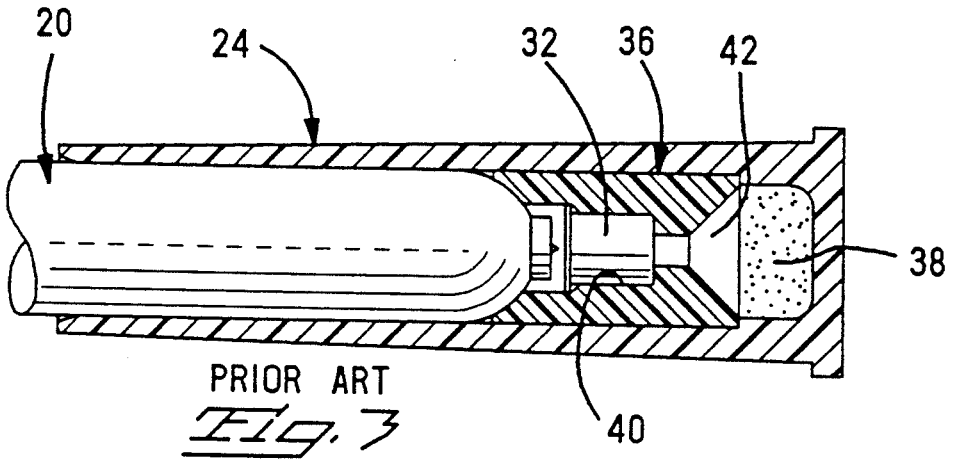
PRIOR ART Fig. 3
FIGS. 3, 4, and 5 are cross-sectional views of the explosive cartridge shown in FIG. 2 showing the ram and the gas check member in positions that correspond to different states of the cartridge.
Figure 5:
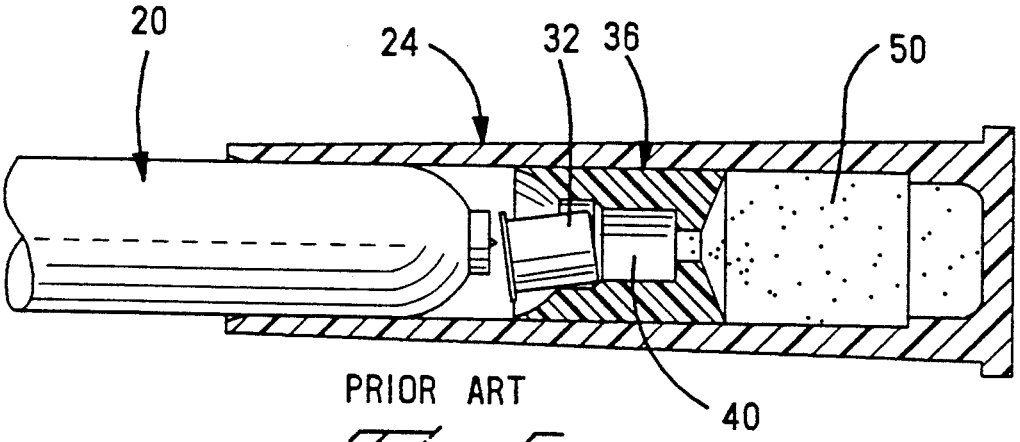
PRIOR ART Fig. 5

There is shown in FIGS. 1 and 2 an explosively operated industrial tool 10 having a breech 12, a breech cap 14 removably mounted to one end of the breech 12, a barrel 16 attached to the other end of the breech 12 by means of a coupling 18, and a ram 20 which is positioned and slidable within both the barrel 16 and the breech 12. A platform 22 is secured to the end of the barrel 16 opposite the coupling 18 by means of screw threads. The platform 22 holds a work piece (not shown) for work to be performed thereon by the ram 20 as it is driven forward by an expanding gas generated by detonating a cartridge 24. As shown in FIG. 2 the breech 12 includes a chamber 26 which receives the cartridge 24 in one end and the ram 20 in the other end. A cartridge ejector 28 is disposed around the breech 12 within a sleeve 30. The sleeve 30 is threadingly attached to the breech 12 and provides a threaded aperture for receiving the breech cap 14. Referring also to FIGS. 3 and 5, the cartridge 24 includes a gas check member 36 having a primer 32 pressed into an outwardly facing opening 40 therein and a charge of explosive powder 38 arranged in a cavity in the end of the cartridge. Another opening 42 in the gas check member 36 is in communication with both the primer 32 and the powder 38.

In operation, a fresh cartridge 24 is inserted into the breech 12 and the breech cap 14 threaded into place. A work piece is then inserted in the tool 10 and the barrel 16 screwed into the platform 22 to bring the tip of the ram 20 into engagement with the work piece. The relative positions of the ram 20, gas check 36, and cartridge 24 prior to firing are shown in FIG. 3. The breech cap 14 is then struck sharply by a hammer. This causes the freely sliding ram 20 to slide rearwardly within the open end of the cartridge 24 and detonate the primer 32. The explosive powder 38 is ignited by the exploding primer causing expanding gases to drive the ram 20 forcefully forward against the work piece to perform the desired work operation.

Figure 4:
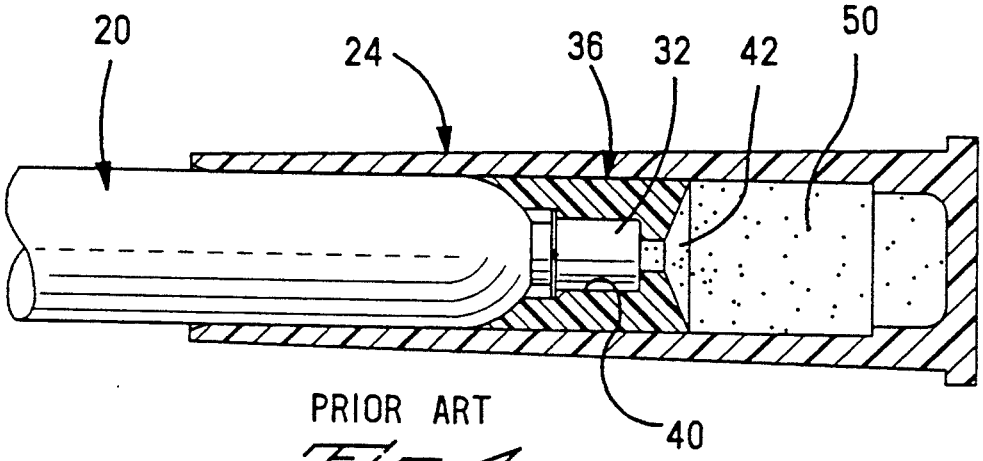
PRIOR ART Fig. 4

At this point in the operation of the tool 10, there is a residual amount of gas 50 remaining in the cartridge, as best seen in FIG. 4. Note that the gas check member 36 has been driven forward within the cartridge along with the ram 20. The heat generated by the discharge has caused the outer walls of the gas check member to fuse with the inner walls of the cartridge. The residual gas 50 exerts pressure within the cavity of the cartridge but cannot escape because the gas check and primer are forced against one end of the ram 20 while the other end of the ram is forced against the work piece. This residual gas 50 is released by means of another element of the tool 10, not shown, that pierces the end of the shell 24 and vents the gas to the atmosphere. After venting the residual gas, the work piece is removed, the expended shell is removed and a fresh cartridge installed, another work piece is inserted into the tool 10, and the process repeated. This venting operation, however, must be performed manually, and occasionally is inadvertently not done prior to removing the work piece. In such cases, the barrel 16 is rotated to cause it to unscrew from the platform 22 causing the ram 20 to back away from the work piece. Since the ram is now free to slide away from the gas check member and primer, and the gas check is fused to the wall of the cartridge, the residual gas 50 is contained only by the primer 32. As shown in FIG. 5, the primer will sometimes, under the urging of the pressure of the residual gas 50, pop out of its seat in the gas check men, her. When the expended shell is later removed the primer, which is now loose, will remain within the bore of the tool 10. When the tool is again used, this loose primer may cause the tool to either not fire properly or to fire prematurely.

Figure 6:
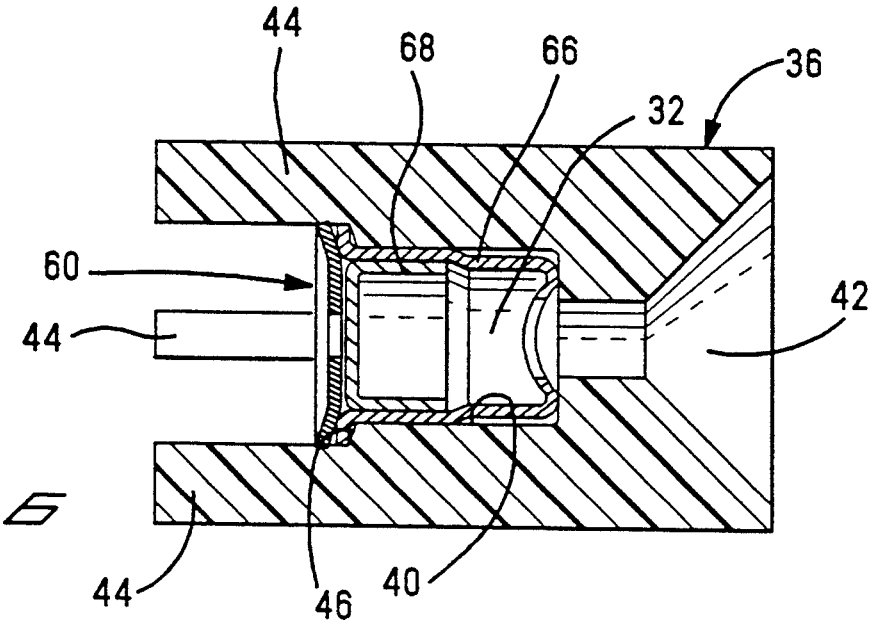
FIG. 6 is an enlarged cross-sectional view of the gas check member and primer shown in FIG. 5.
Figure 7:
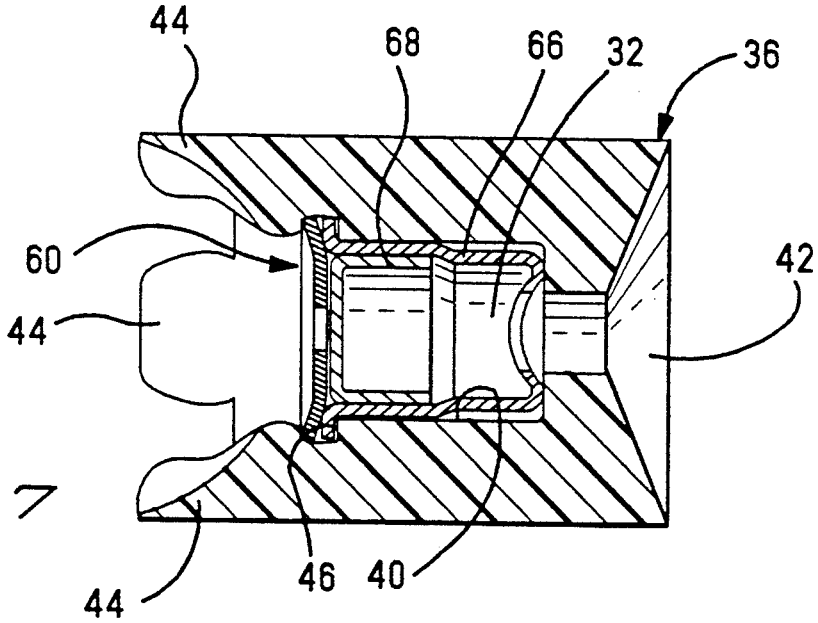
FIG. 7 is an enlarged cross-sectional view of the gas check member and primer shown in FIG. 6 after the cartridge has been fired.
Figure 8:
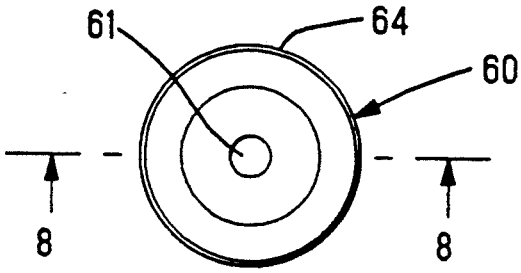
FIG. 8 is a plan view of a retaining member shown in FIG. 6.
Figure 9:
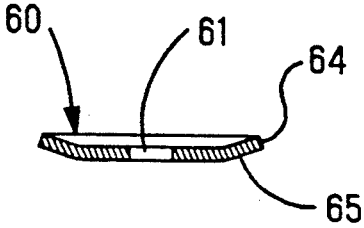
FIG. 9 is a cross-sectional view taken along the lines 9—9 in FIG. 8.

The present invention solves this problem by providing a retaining plate 60 which locks the primer 32 in position within the opening 40 and against a shoulder 46 in the gas check member 36, as shown in FIG. 6. The retaining plate 60 includes an opening 61 for permitting the end of the ram 20 access to detonate the primer. The gas check member 36 includes two or more legs 44 extending from the end thereof and equally spaced about the outwardly facing opening 40 containing the primer 32. These legs 44 are used to space the end of the ram 20 with respect to the primer when the tool has a work piece in position, prior to firing. The retaining plate 60 has a peripheral edge 64, as shown in FIGS. 7 and 8, that interferingly engages the opposing walls of the legs 44, as shown in FIG. 6. The edge 64 is beveled upwardly, as at 65 in FIG. 9, so that the plate 60 can be forced between the legs 44 and pressed into position against the primer 32. The edge 64 digs into the walls thereby trapping the primer 32 in the opening 40 and securing it against the shoulder 46 of the gas check member 36. When the cartridge is fired, the gas check member and primer are forced against the ram 20 and in turn force it to impact the work piece. The forces generated cause the gas check member 36 to deform as shown in FIG. 7. This deformation, while not itself able to retain the primer 32 in place, helps to assure that the retaining plate 60 remains firmly in place in the gas check member 36. Some primers are constructed with a cylindrical body 66 and a detonator cap 68 pressed into the body, as best seen in FIG. 6, so that when the residual gas 50 urges the primer out of its seat the detonator cap 68 can be forced out of the body 66 and thereby also become a loose part within the tool 10. For this reason the hole 61 is dimensioned slightly smaller than the diameter of the detonator cap 68. This assures that both the detonator cap 68 and the complete primer 32 will remain within the opening 40 in the gas check member 36 after firing of the cartridge and inadvertent removal of the work piece prior to venting of the residual gas 50. While the retaining plate 60 is shown, in the present example, to be washer shaped, rectangular or other shapes may be advantageously utilized.

An important advantage of the present invention is that primers and detonator caps are effectively prevented from becoming dislodged from the gas check member after firing, thereby greatly enhancing the reliability and the safety of the tool. Further, this is accomplished without the need for expensive or complex modifications to the present tool or to the gas check member of the cartridge.

It is thought that the improved cartridge of the present invention and many of its attendant advantages will be understood from the foregoing description. It is apparent that various changes may be made in the form, construction, and arrangement of the parts thereof without departing from the spirit or scope of the invention or sacrificing all of its material advantages.

I claim:

1. In a cartridge for use in an explosively operated industrial tool, said cartridge having an elongated shell which is open at one end and closed at a base end and having a chamber at said base end containing explosive powder, a gas check assembly within said shell adjacent said explosive powder comprising;

(a) a gas check member having an outwardly facing first opening in a first end, said first opening extending through said member to a second end adjacent said explosive powder opposite said first end, (b) a primer having a detonator end, said primer arranged within said first opening so that said detonator end is facing outwardly, said primer being seated against a shoulder within said first opening, and (c) a retaining member associated with said gas check member for retaining said primer within said first opening, said retaining member comprising a plate having an opening therethrough adjacent to and in alignment with said detonator end, said plate having a peripheral edge that is turned outwardly in a direction away from said detonator end, said peripheral edge being in interfering engagement with opposing walls of at least two projections extending from said first end on opposite sides of said first opening, whereby said plate is secured to said gas check member so that said plate retains said primer within said first opening.

2. The gas check assembly according to claim 1 wherein said primer includes a body and a separate detonator cap pressed into an end of said body, and wherein said opening of said plate is centrally located in said plate and is smaller than said detonator cap.

3. The gas check assembly according to claim 1 wherein said at least two projections of said gas check member includes four such projections substantially equally spaced about the periphery of said first opening.

4. The gas check assembly according to claim 1 wherein said peripheral edge is round and said opening through said plate is a round opening.

5. The gas check assembly according to claim 1 wherein said plate comprises a relatively thin flat washer.

6. A cartridge for use in an explosively operated industrial tool having an elongated shell which is open at one end and closed at a base end, said shell having a chamber at said base end containing explosive powder, and a gas check member within said shell adjacent said explosive powder, said gas check member having an outwardly facing first opening in a first end and a second opening extending from a second end adjacent said explosive powder through said gas check member to and in communication with said first opening, a primer having a detonator end arranged within said first opening so that said detonator end is facing outwardly, said primer being seated against a shoulder within said first opening, and a retaining member associated with said gas check member for retaining said primer within said first opening, said retaining member comprising a plate having an opening therethrough adjacent to and in alignment with said detonator end, said plate having a peripheral edge that is turned outwardly in a direction away from said detonator end, said peripheral edge being in interfering engagement with opposing walls of projections extending from opposite sides of said first opening thereby securing said plate to said gas check member during and subsequent to said ignition of said primer and said explosive powder.

7. The cartridge according to claim 6 wherein said primer includes a body and a separate detonator cap pressed into an end of said body, and wherein said opening of said plate is centrally located in said plate and is smaller than said detonator cap.

8. The gas check assembly according to claim 6 wherein said plate comprises a relatively thin flat washer.

* * * * *